United States Patent [19]

Johnson

[11] 4,272,803

[45] Jun. 9, 1981

[54] ADJUSTABLE TROUBLE LAMP SUPPORT

[76] Inventor: Alton L. Johnson, 1280 Eustis St., St. Paul, Minn. 55108

[21] Appl. No.: 21,509

[22] Filed: Mar. 19, 1979

[51] Int. Cl.[3] ..... H01K 5/00

[52] U.S. Cl. ..... 362/399; 362/400; 362/344; 362/407; 362/387; 362/427

[58] Field of Search ..... 362/109, 399, 400, 344, 362/407, 387, 382, 396, 427, 451, 418, 430, 378

[56] References Cited

U.S. PATENT DOCUMENTS

| | | | |
|---|---|---|---|
| 2,653,219 | 9/1953 | Popp | 362/99 |
| 3,808,420 | 4/1974 | Gortner | 362/396 |

*Primary Examiner*—Benjamin R. Padgett
*Assistant Examiner*—J. L. Barr
*Attorney, Agent, or Firm*—Kinney, Lange, Braddock, Westman & Fairbairn

[57] ABSTRACT

An adjustable trouble lamp support which includes a hook, a friction swivel and a clamping bracket for attaching the support to a trouble lamp. The hook includes a curved section and a shank section with the hook sufficiently large to substantially extend beyond the periphery of the trouble lamp cage at any angular position.

The friction swivel includes a portion of the shank section that is attached on an incline to the center of a disc, a spring located around this portion of the shank section and a housing enclosing the spring and shank section whereby the spring is compressed and a frictional force is produced between the disc and housing.

12 Claims, 5 Drawing Figures

ADJUSTABLE TROUBLE LAMP SUPPORT

BACKGROUND OF THE INVENTION

1. Field of the Invention

This invention relates to trouble lamps and trouble lamp supports therefor, and more particularly to supports used for hanging the trouble lamp or maintaining the trouble lamp in any desired angular position on the ground.

2. Description of the Prior Art

The prior art shows many attempts in providing a suitable, adjustable support for a trouble lamp. The Gortner patent, U.S. Pat. No. 3,808,420, discloses a hanging support that is rotatable to six different positions. This type of adjustable trouble light support limits the positioning of the trouble light to six positions and causes a great inconvenience in a situation where only a fractional adjustment is required. Further, to accomplish even the adjustment, one has to pull on the support, rotate the trouble lamp and let go. Thus, even to get an unacceptable adjustment, one has to place his tools down, reach for the trouble lamp with both hands, and adjust it, and then resume work.

The Lieuwen patent, U.S. Pat. No. 2,788,438, shows an infinitely adjustable trouble lamp support. However, this adjustable support is of no value when the trouble lamp is laid on the ground and needs support therefrom.

The patent of Dunkelberger, U.S. Pat. No. 2,570,329, shows a trouble lamp support that permits swiveling of the lamp with respect to the hook. This permits the trouble lamp support to be used as a stand. However, this type of adjustable trouble lamp support is not adaptable to the present day trouble lamp configuration which uses a side reflection shield. The present day trouble lamp needs a support that has the capability of rotation about the longitudinal axis of the trouble lamp cage.

The present invention provides both an adjustable hanging support and an adjustable support when the trouble lamp is laid on the ground. It further provides a support that can be manufactured with the trouble lamp, or can be manufactured separately and sold to persons already owning existing trouble lamps.

SUMMARY OF THE INVENTION

The present invention provides both a hanging adjustable trouble lamp support and a support for a trouble lamp when it is laid on the ground. In the preferred embodiment of the invention, the adjustable trouble lamp support includes a trouble lamp, a hook with a straight shank section, a frictional swivel and a bracket that attaches to the trouble lamp.

The hook includes a curved section and a straight shank section, with the hook sufficiently large to substantially extend beyond the periphery of said trouble lamp cage at any angular position. The purpose of the hook extending substantially beyond the periphery of the trouble lamp cage is to provide a stable support when the trouble lamp is laid on the ground. If the hook did not substantially extend beyond the cage of the trouble lamp, the trouble lamp would be free to roll around.

The frictional swivel allows a continuous number of adjustments with the trouble lamp. The smallest or the largest adjustment is simply accomplished by twisting of the trouble lamp.

DESCRIPTION OF THE PREFERRED EMBODIMENTS

Figure 1:
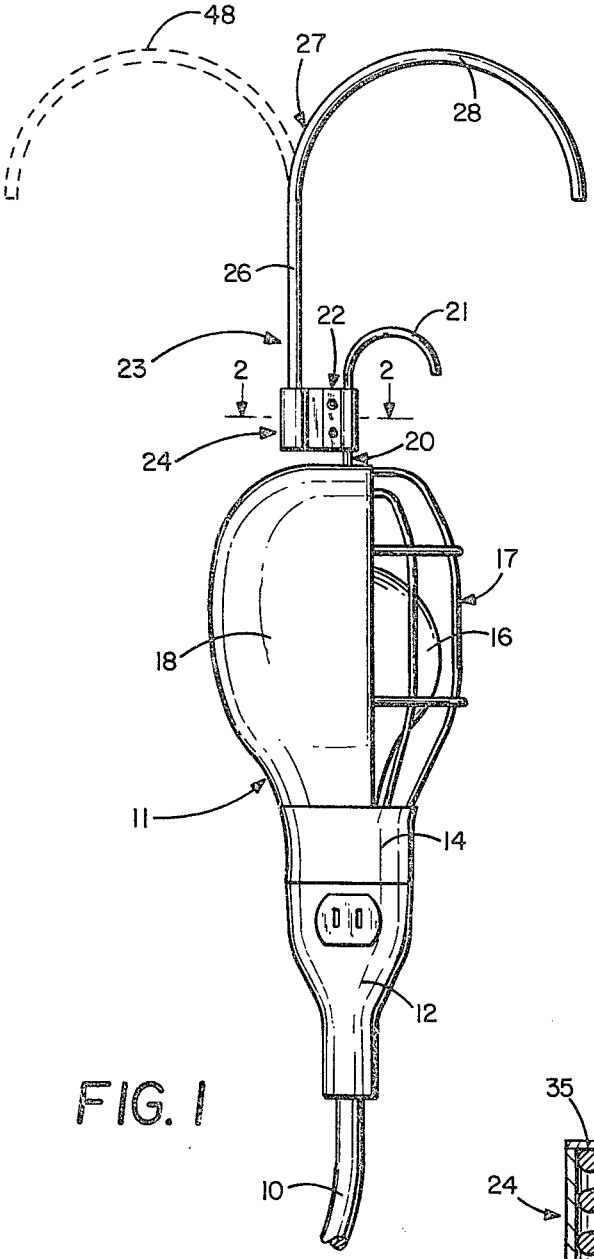
FIG. 1 is an elevational view of one embodiment of the present invention.
Figure 2:
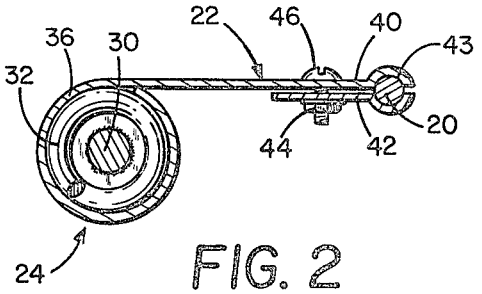
FIG. 2 is a sectional view taken along the line 2—2 in FIG. 1.

Referring to FIG. 1, a trouble lamp with the adjustable support of the present invention is shown. The trouble lamp 11, except for the novel support, is of conventional structure and consists of a cord 10, a handle 12, and a socket 14 to hold a bulb 16. A cage 17 having a reflector 18 surrounds the bulb protecting it. A rod 20 is rigidly secured to and protrudes from the outer end of the cage along the longitudinal axis of the trouble lamp. The rod 20 has a straight shank portion and a curved outer portion 21 which constitutes the normal rigid hook of a conventional trouble lamp.

The trouble lamp support of the present invention generally indicated at 23 includes a bracket 22 attached to the rod member 20 protruding from the trouble lamp. Attached to this clamping bracket is a frictional swivel 24 which allows adjustment for the trouble lamp support. The support further consists of a shank section 26 having an outer curved section 28 forming a hook 27.

The hook 27 of the present invention extends substantially beyond the periphery of the trouble lamp cage at any angular position. In other words, the transverse distance from the line of attachment to rod 20 to the outermost periphery formed by the hook should be larger than the transverse distance from the line of attachment to rod 20 to the outermost periphery of the trouble lamp cage at any angular position of the trouble lamp cage.

Figure 3:
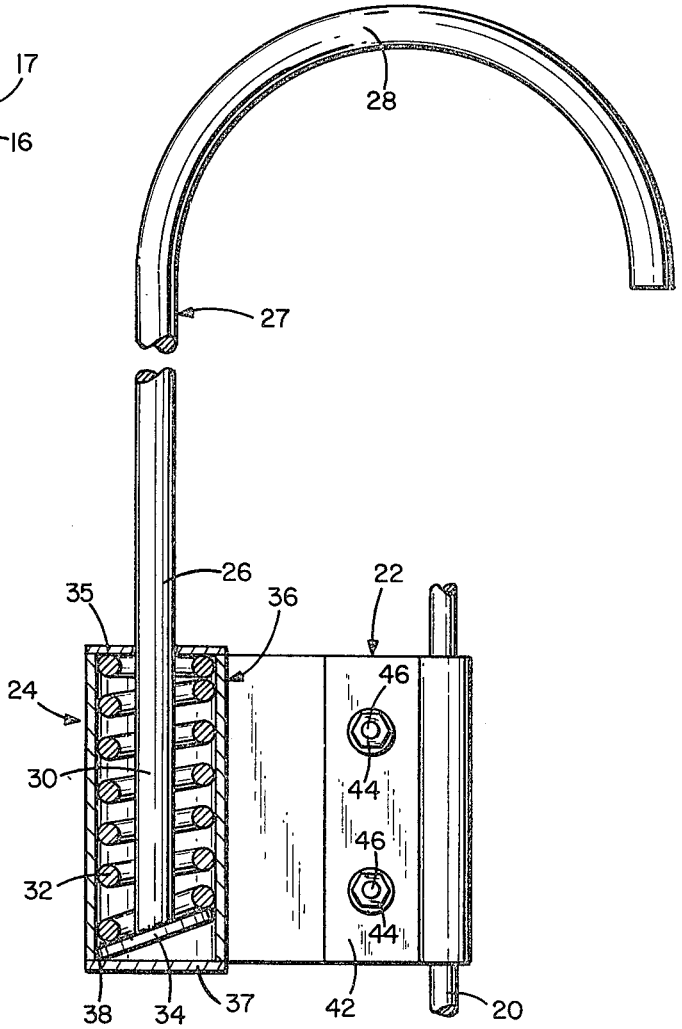
FIG. 3 is a view of the support of the present invention with the frictional swivel being shown in cross-section.

The frictional swivel 24 is shown in detail in FIG. 3. The frictional swivel includes a lower end portion 30 of the shank section 26 and a spring 32 located around end portion 30. A disc 34 is fixedly attached to the lower end portion 30 of the shank section 26. The disc 34 can be attached by such standard means as welding. A housing 36 encloses the spring 32, the disc 34 and the portion 30 of the shank section. The spring 32 is held under compression between an upper end wall 35 of housing 36 and the disc 34, thus pushthe disc 34 against a lower wall 37 creating a frictional force at area 38. It should be understood that any resilient material may be used in place of spring 32. The disc 34 is preferably secured to the lower end of the end portion 30 so that it is inclined at an angle of approximately 20° with respect to a plane perpendicular to the axis of the end portion 30. Because of the inclination, the engagement of the disc 34 with the end wall 37 of the housing 36 is limited to the small area 38. It has been found that this enables the shank 26 to be turned readily to the desired angle by grasping hook section 28. At the same time, the frictional force is sufficient to enable the hook section 28 to be maintained in the position to which it is moved. The outer surfaces of spring 32 preferably engages the inner annular wall of housing 36 when it is in the compressed position shown. This further adds to the friction retaining the hook 28 in the position to which it is adjusted.

Figure 4:
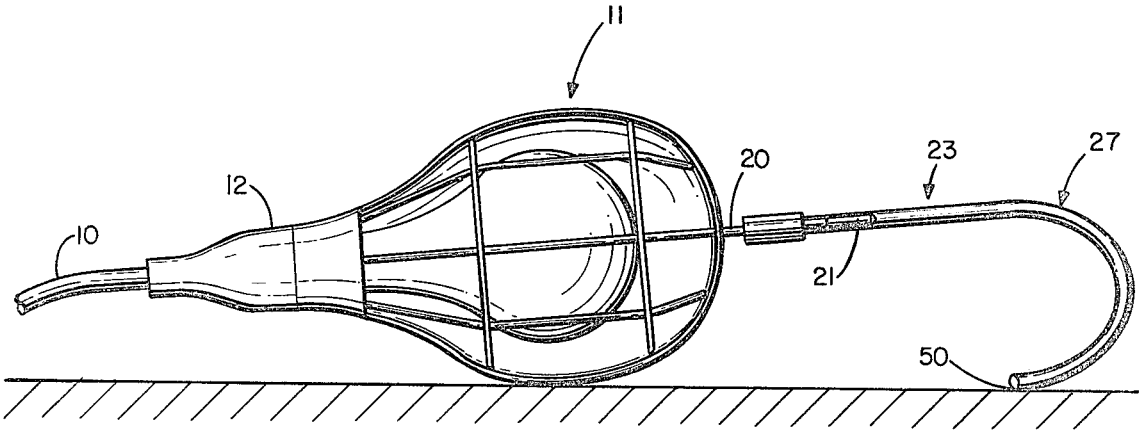
FIG. 4 is a side elevational view of the trouble lamp of the present invention supported on the ground; and, FIG. 5 is an end elevational view of the lamp supported on the ground.
Figure 5:
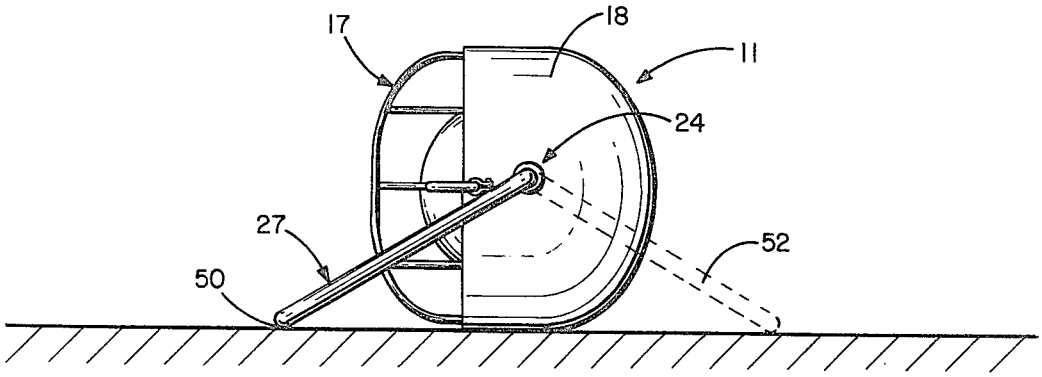

In use, the trouble lamp 11 may be adjusted in a hanging position to, for example, the dotted line position 48 of FIG. 1. FIG. 4 shows the trouble lamp 11 in a horizontal position on the ground. The trouble lamp support 23 can be rotated about an axis parallel to the length of the trouble lamp to any position and the hook 27 will provide support from the ground at point 50. In the prior art, attention was directed to the hanging position and trouble lamp supports having hooks sufficient for hanging purposes were produced. This type of a hook does not provide any support to a trouble lamp when it is laid on the ground. The hook of the present invention solves this problem by providing a rotatable hook that extends beyond the periphery of the trouble lamp cage and touches the ground at point 50, providing support for the position desired. FIG. 5 further illustrates the versatility of the support of the present invention. The present invention allows the light of the trouble lamp to be directed in any desired direction while hook 27 prevents the lamp from rolling by providing support at point 50. The hook can also provide support from another position as shown by dotted line 52.

Further, the trouble lamp support may be manufactured separately from the trouble lamp and used as a support for existing trouble lamps. This versatility is absent in the prior art.

Although the present invention has been described with reference to preferred embodiments, persons skilled in the art will recognize that changes may be made in form and detail without departing from the spirit and scope of the invention.

I claim:

1. An adjustable trouble lamp comprising:

elongated electrical cord means;

handle means;

socket means secured to said handle means and to which said cord means is conductively connected, said socket means being for the purpose of conductively receiving a conventional bulb means;

conventional lamp guard cage means attached to said handle means for the protection of said bulb means;

a reflector surrounding part of the cage means for directing light from the bulb means in a particular direction;

an elongated rod member attached to said cage means on the end opposite said handle means and protruding a short distance therefrom;

a support comprising a hook including a curved section and a substantially straight shank section;

friction swivel means pivotally connected to the shank section of said hook; and clamping bracket means fixedly attached to said friction swivel means and clamping said support to said elongated rod member, the hook being sufficiently large that the transverse distance from the line of attachment of the support to said elongated rod member to the outermost periphery of the hook is larger than the transverse distance from said line of attachment to the outermost periphery of the trouble lamp cage at any angular position of the trouble lamp cage.

2. An adjustable trouble lamp as defined in claim 1 wherein said frictional swivel means includes a portion of said shank section of the hook that is fixedly attached on an incline to the center of a flat disc, a resilient means located around said portion of the shank and a housing, with side and end walls, enclosing said resilient means and shank section wherein said resilient means is compressed and imparts a force to said disc, producing a frictional engagement between said disc and one end wall of said housing.

3. An adjustable trouble lamp as defined in claim 2 wherein said disc is inclined approximately 20° from a plane perpendicular to said shank section.

4. An adjustable trouble lamp as defined in claim 2 wherein said resilient means engages the inner surface of said side wall.

5. An adjustable trouble lamp as defined in claim 2 wherein said resilient means is a coil type spring.

6. An adjustable trouble lamp support as defined in claim 1 wherein the clamping bracket means includes two flat plates, said plates having their opposing surfaces sufficiently recessed to enable proper engagement with said rod member, and a plurality of bolts engaging said plates, providing the required clamping force.

7. An adjustable trouble lamp support for a conventional trouble lamp having an elongated electrical cord means, a handle means, socket means for retaining a bulb and having said electrical cord conductively connected thereto, a lamp guard cage means attached to the handle means for the protection of the bulb means, a reflector partially surrounding the cage means and an elongated rod member attached to the cage means and projecting outwardly therefrom, said support comprising:

a hook including a curved section and a substantially straight shank section;

friction swivel means pivotally connected to the shank section of said hook; and, clamping bracket means fixedly attached to said friction swivel means for clamping said support to such an elongated rod member of a trouble lamp, the hook being sufficiently large that the transverse distance from the line along which the clamping bracket means is designed to be clamped to said elongated rod member to the outermost periphery of the hook is greater than the distance between said line and the outermost periphery of the cage of such a trouble lamp regardless of the angular position of the trouble lamp.

8. An adjustable trouble lamp support as defined in claim 7 wherein said frictional swivel means includes a portion of said shank section of the hook that is fixedly attached on an incline to the center of a flat disc, a resilient means located around said portion of the shank, and a housing, with a side and end walls, enclosing said resilient means and shank section whereby said resilient means is compressed and imparts a force to said disc, producing a frictional engagement between said disc and one end wall of said housing.

9. An adjustable trouble lamp support as defined in claim 8 wherein said resilient means is a coil type spring.

10. An adjustable trouble lamp support as defined in claim 8 wherein said resilient means engages the inner surface of said side wall.

11. An adjustable trouble lamp support as defined in claim 8 wherein said disc is inclined approximately 20° from a plane perpendicular to said shank section.

12. An adjustable trouble lamp support as defined in claim 7 wherein the clamping bracket means includes two flat plates, said plates having their opposing surfaces sufficiently recessed to enable proper engagement with said rod member, and a plurality of bolts engaging said plates, providing the required clamping force.

* * * * *